US010648669B2

(12) United States Patent
Varney et al.

(10) Patent No.: US 10,648,669 B2
(45) Date of Patent: May 12, 2020

(54) CASE AND LINER ARRANGEMENT FOR A COMBUSTOR

(71) Applicants: Rolls-Royce Corporation, Indianapolis, IN (US); Rolls-Royce North American Technologies, Inc., Indianapolis, IN (US)

(72) Inventors: Bruce E. Varney, Greenwood, IN (US); Ted J. Freeman, Danville, IN (US); Adam L. Chamberlain, Mooresville, IN (US)

(73) Assignees: Rolls-Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 640 days.

(21) Appl. No.: 15/214,865

(22) Filed: Jul. 20, 2016

(65) Prior Publication Data

US 2017/0051917 A1 Feb. 23, 2017

Related U.S. Application Data

(60) Provisional application No. 62/208,338, filed on Aug. 21, 2015.

(51) Int. Cl.

| | |
|---|---|
| ***F23R 3/60*** | (2006.01) |
| ***F23R 3/00*** | (2006.01) |
| ***F23R 3/46*** | (2006.01) |

(52) U.S. Cl.

CPC ..... *F23R 3/007* (2013.01); *F23R 3/002* (2013.01); *F23R 3/46* (2013.01); *F23R 3/60* (2013.01)

(58) Field of Classification Search

CPC .... F23R 3/007; F23R 3/60; F23R 3/46; F23R 3/002; F23R 3/34; F23R 3/44; F23R 3/42; F02C 7/20; F05D 2240/90; F05D 2240/91

See application file for complete search history.

(56) References Cited

U.S. PATENT DOCUMENTS 2,699,648 A * 1/1955 Berkey ..... F23R 3/08 431/352
3,911,672 A * 10/1975 Irwin ..... F02C 7/266 60/753

(Continued)

FOREIGN PATENT DOCUMENTS

EP 0136071 A1 4/1985
WO 2015009384 A1 1/2015

OTHER PUBLICATIONS

The Jet Engine, edition first published 2005 by Rolls-Royce plc.; this impression published 2015 by John Wiley & Sons, Ltd on behalf of Rolls-Royce plc.; Combustors pp. 112-129.*

(Continued)

*Primary Examiner* — Gerald L Sung
*Assistant Examiner* — Alyson Joan Harrington
(74) *Attorney, Agent, or Firm* — Barnes & Thornburg LLP

(57) ABSTRACT

A combustor adapted for use in a gas turbine engine is disclosed. The combustor includes a metallic case forming a cavity and a ceramic liner arranged in the cavity of the metallic case. The ceramic liner defines a combustion chamber in which fuel is burned during operation of a gas turbine engine. The ceramic liner is located in the metallic case using a plurality of cross key connectors.

17 Claims, 6 Drawing Sheets

(56) References Cited

U.S. PATENT DOCUMENTS

| | | | | |
|---|---|---|---|---|
| 4,109,459 | A * | 8/1978 | Ekstedt | F23R 3/002 431/352 |
| 5,291,732 | A | 3/1994 | Halila | |
| 5,623,827 | A * | 4/1997 | Monty | F23R 3/10 60/747 |
| 5,687,572 | A | 11/1997 | Schrantz et al. | |
| 6,895,761 | B2 * | 5/2005 | Mitchell | F23R 3/007 60/752 |
| 6,904,757 | B2 * | 6/2005 | Mitchell | F23R 3/007 60/800 |
| 7,093,441 | B2 | 8/2006 | Burd et al. | |
| 7,249,462 | B2 | 7/2007 | Aumont et al. | |
| 7,464,554 | B2 | 12/2008 | Cheung et al. | |
| 7,770,398 | B2 | 8/2010 | De Sousa et al. | |
| 7,788,928 | B2 | 9/2010 | De Sousa et al. | |
| 7,908,867 | B2 | 3/2011 | Keller et al. | |
| 8,141,370 | B2 | 3/2012 | Bulman et al. | |
| 8,307,657 | B2 * | 11/2012 | Chila | F23R 3/06 431/350 |
| 8,745,989 | B2 | 6/2014 | Prociw et al. | |
| 8,863,528 | B2 * | 10/2014 | Shi | F23R 3/007 60/753 |
| 2004/0118127 | A1 * | 6/2004 | Mitchell | F23R 3/007 60/796 |
| 2006/0242965 | A1 * | 11/2006 | Shi | F23R 3/007 60/796 |
| 2008/0264065 | A1 * | 10/2008 | Gerendas | F23R 3/002 60/754 |
| 2009/0193813 | A1 * | 8/2009 | Garry | F23M 5/04 60/796 |
| 2009/0226279 | A1 | 9/2009 | Jarmon | |
| 2009/0324393 | A1 * | 12/2009 | Gonzalez | F01D 11/08 415/170.1 |
| 2010/0307162 | A1 * | 12/2010 | Bottcher | F23M 5/04 60/752 |
| 2011/0030378 | A1 * | 2/2011 | Carlisle | F23R 3/002 60/753 |
| 2012/0047905 | A1 * | 3/2012 | Rauch | F01D 25/14 60/752 |
| 2012/0291437 | A1 * | 11/2012 | Moehrle | F23R 3/002 60/722 |
| 2012/0328366 | A1 * | 12/2012 | Jarmon | F23R 3/007 403/376 |
| 2013/0019603 | A1 * | 1/2013 | Dierberger | F23R 3/002 60/772 |
| 2014/0190167 | A1 * | 7/2014 | Shi | F23R 3/007 60/737 |
| 2016/0003192 | A1 * | 1/2016 | Roberge | F01D 25/08 60/782 |

OTHER PUBLICATIONS

Extended European Search Report issued in connection with European Application No. 16181654.1-1602, dated Jan. 5, 2017, 7 pages.

* cited by examiner

CASE AND LINER ARRANGEMENT FOR A COMBUSTOR

CROSS REFERENCE TO RELATED APPLICATIONS

This application claims priority to and the benefit of U.S. Provisional Patent Application No. 62/208,338, filed 21 Aug. 2015, the disclosure of which is now expressly incorporated herein by reference.

FIELD OF THE DISCLOSURE

The present disclosure relates generally to combustors used in gas turbine engines, and more specifically to a combustor including a metallic case and a liner connected by cross key connectors.

BACKGROUND

Engines, and particularly gas turbine engines, are used to power aircraft, watercraft, power generators and the like. Gas turbine engines typically include a compressor, a combustor, and a turbine. The compressor compresses aft drawn into the engine and delivers high pressure air to the combustor. The combustor is a component or area of a gas turbine engine where combustion takes place. In a gas turbine engine, the combustor receives high pressure air and adds fuel to the air which is burned to produce hot, high-pressure gas. After burning the fuel, the hot, high-pressure gas is passed from the combustor to the turbine. The turbine extracts work from the hot, high-pressure gas to drive the compressor and residual energy is used for propulsion or sometimes to drive an output shaft.

Combustors include liners that contain the combustion process during operation of a gas turbine engine. The liner included in the combustor is designed and built to withstand high-temperature cycles induced during combustion. In some cases, liners may be made from metallic superalloys. In other cases, liners may be made from ceramic matrix composites (CMCs) which are a subgroup of composite materials as well as a subgroup of technical ceramics. CMCs may comprise ceramic fibers embedded in a ceramic matrix. The matrix and fibers can consist of any ceramic material, whereby carbon and carbon fibers can also be considered a ceramic material.

Combustors and turbines made of metal alloys often require significant cooling to be maintained at or below their maximum use temperatures. The operational efficiencies of gas turbine engines are sometimes increased with the use of CMC materials that require less cooling and have operating temperatures that exceed the maximum use temperatures of most metal alloys. The reduced cooling required by CMC combustor liners when compared to metal alloy combustion liners can permit greater temperature uniformity and thereby leads to reduced undesirable emissions.

One challenge relating to the use of CMC liners is that they are sometimes secured to the surrounding metal shell via metal fasteners. Metal fasteners lose their strength and may even melt at CMC operating temperatures. Since the allowable operating temperature of a metal fastener is lower than the allowable operating temperature of the CMC, metal fasteners, and/or the area surrounding it, is often cooled to allow it to maintain its strength. Such a configuration may undermine the desired high temperature capability of the CMC. Accordingly, new techniques and configurations are needed for securely fastening liner material, such as CMC to the walls of enclosures experiencing high-temperature environments.

SUMMARY

The present disclosure may comprise one or more of the following features and combinations thereof.

A combustor assembly may include case comprising metallic materials adapted to be mounted in a gas turbine engine and formed to define an interior space a combustion liner comprising ceramic matrix composite materials arranged in the interior space of the case, and a plurality of pins. The combustion liner may be shaped to define a combustion chamber within the case and shield at least a portion of the case from the combustion chamber. The plurality of pins extend through the case and into blind holes formed in the combustion liner to provide cross key connections between the case and the combustion liner locating the combustion liner relative to the case.

In some embodiments, the cross key connections are spaced circumferentially about the case to locate the combustion liner centrally within the case. Each of the plurality of pins includes a head that couples with the case and a shank that extends into the blind holes formed in the combustion liner. Each head may include threads configured to couple with bosses in the case.

According to another aspect of the present disclosure, a method of assembling a combustor may include positioning a combustion liner comprising ceramic matrix composite materials/in an interior space formed by a case comprising metallic material. The combustion liner may shaped to define a combustion chamber within the interior space and to shield at least a portion of the case from the combustion chamber. The method may further include establishing cross key connections between the combustion liner and the case by inserting a plurality of pins through the case and into the combustion liner. The combustion liner may be formed to include at least one full ceramic hoop including a plurality of blind holes radially spaced around the hoop for locating the hoop with the plurality of pins.

These and other features of the present disclosure will become more apparent from the following description of the illustrative embodiments.

DETAILED DESCRIPTION OF THE DRAWINGS

Figure 1:
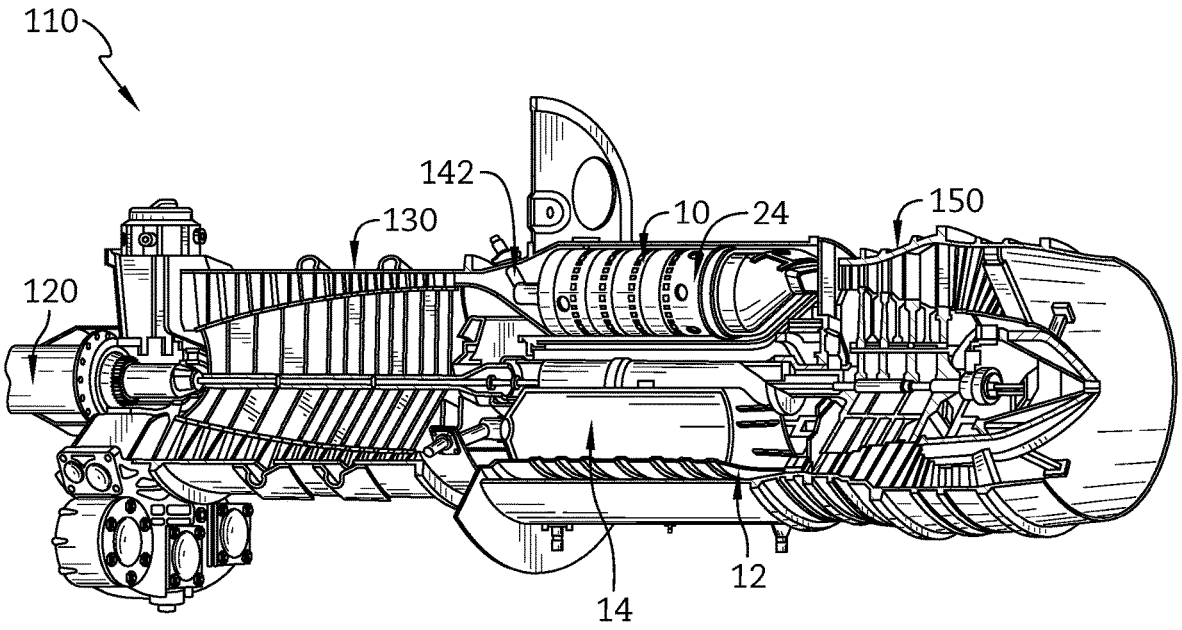
FIG. 1 is a perspective cut-away view of a turbine engine showing that the engine includes a can-type combustor assembly.

For the purposes of promoting an understanding of the principles of the disclosure, reference will now be made to a number of illustrative embodiments illustrated in the drawings and specific language will be used to describe the same.

The arrangement of an illustrative combustor 10 in a gas turbine engine 110 is shown in FIG. 1. The gas turbine engine 110 includes an output shaft 120, a compressor 130, the combustor 10, and a turbine 150. The output shaft 120 is driven by the turbine 150 and may drive a propeller, a gearbox, a pump, or the like (not shown) depending on the application of the gas turbine engine 110. The compressor 130 compresses and delivers air to the combustor 10. The combustor 10 mixes fuel with the compressed air received from the compressor 130 and ignites the fuel. The hot, high pressure products of the combustion reaction in the combustor 10 are directed into the turbine 150 and the turbine 150 extracts work to drive the compressor 130 and the output shaft 120.

Figure 2:
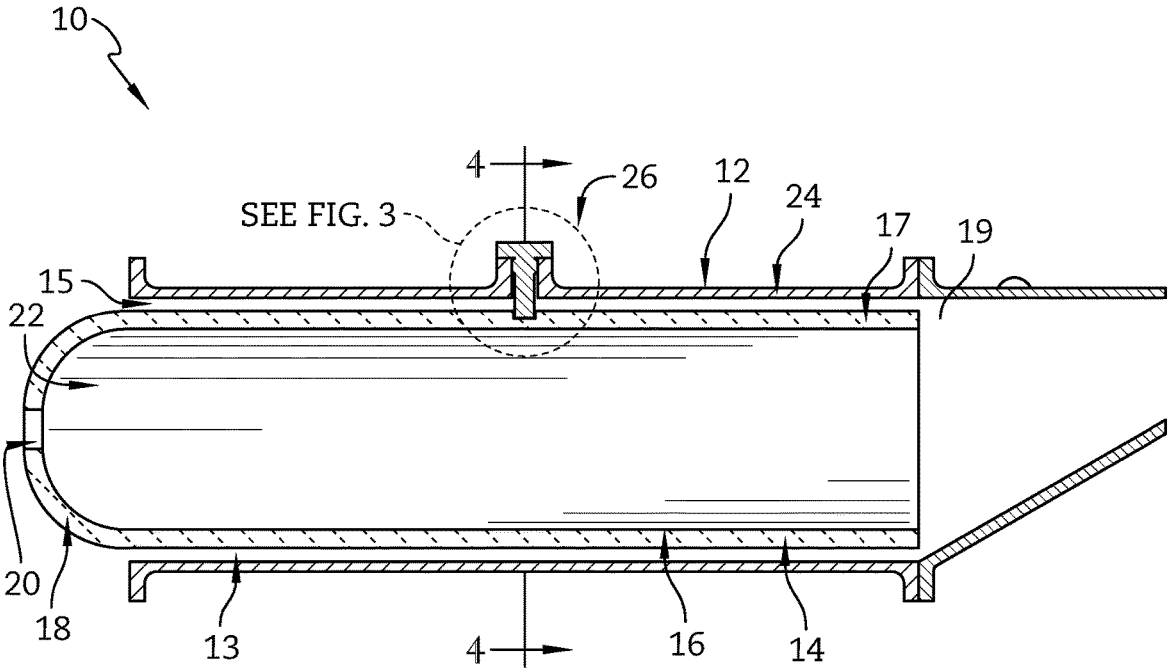
FIG. 2 is a sectional view of a portion of the can-type combustor of FIG. 1 showing the combustor includes a ceramic domed liner mounted to a metallic case by cross key connectors.

The combustor is a can-type combustor assembly including a case 12, a liner 14 received in the case 12, and a cross key connection 26 coupling the liner 14 to the case 12 in FIG. 2. The case 12 is coupled to an engine frame and supports the liner 14 in the engine frame. The liner 14 protects the case 12 from heat generated by the combustion reaction contained therein. The cross key connection 26 locates the liner 14 in an interior space 19 relative the case 12 without requiring fasteners that extend through parts of the liner 14 into an internal combustion cavity 22 of the liner 14. In some embodiments, cooling holes (not shown) may be machined or otherwise formed in the liner 14 to force pressurized cooling air to enter the combustion cavity 22.

The case 12 includes a plurality of case cans 24 as shown in FIG. 1. The case cans 24 are formed from a metallic material. Each can 24, has a generally longitudinal annular opening 15 to accommodate the liner 14 radially inward. Each can 24 has three or more threaded bosses 38 that form openings in the wall of the can 24 to form a portion of the cross key connection 26 with the liner 14.

The liner 14 includes a plurality of liner cans 15 formed of a ceramic matrix composite material as shown in FIG. 2. Each liner can 17 is formed to include a cylindrical hoop 16 and a dome-shaped end 18. Each hoop 16 is sized to fit radially inside the longitudinal annular opening 15 of a can 24 so that a channel 13 exists between the hoop 16 and the can 24. In the illustrative embodiment, an opening 20 is formed in the domed-shaped proximal end 18 to accommodate a fuel nozzle 142. Hoop 16 is formed to further include three or more blind holes 36 to align with the three or more threaded bosses 38 in forming the cross key connections 26.

The liner 14 and the casing 12 define an interior cylindrical space or cooling channel 13 therebetween. Heat is prevented from entering the proximal end of the cooling channel 13 via the domed proximal end 18 and opening 20 guiding the fuel nozzle 142 directly into a combustion chamber 22 within the liner 14. The liner is connected by a cross key connection 26 extending through the casing 12 and into the liner 14.

Cross key connection 26 includes one or more pins 28 having a head 30 and a shank 34. Adjacent the head 30, a plurality of threads 32 are formed on a proximal end of the shank 34. Pins 28 extend through and threadingly engage the threaded bosses 38 via the threads 32 on shank. The distal end of the shank 34 of the pin 28, opposite the threads 32, is sized to fit into blind hole 36 of hoop 16.

Figure 3:
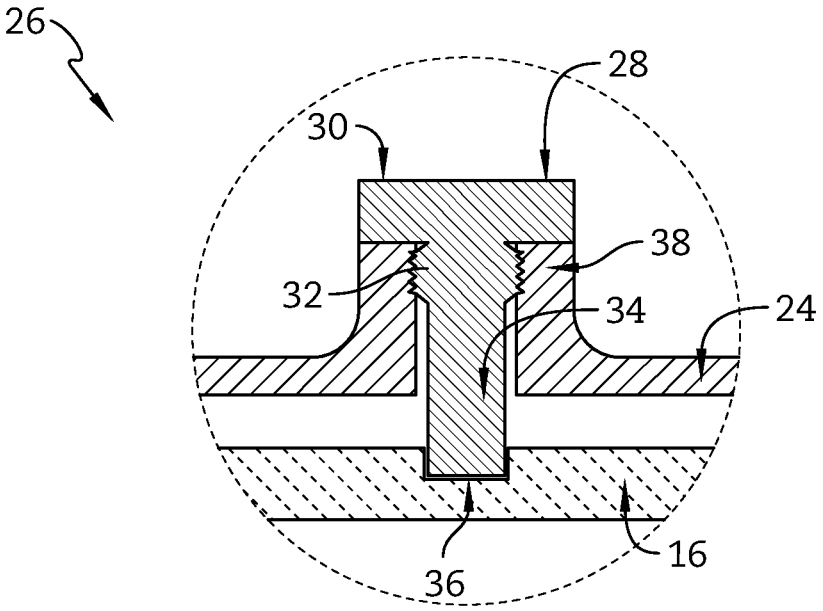
FIG. 3 is a zoomed in view of the connector of FIG. 2 that connects the ceramic liner to the metallic case.
Figure 4:
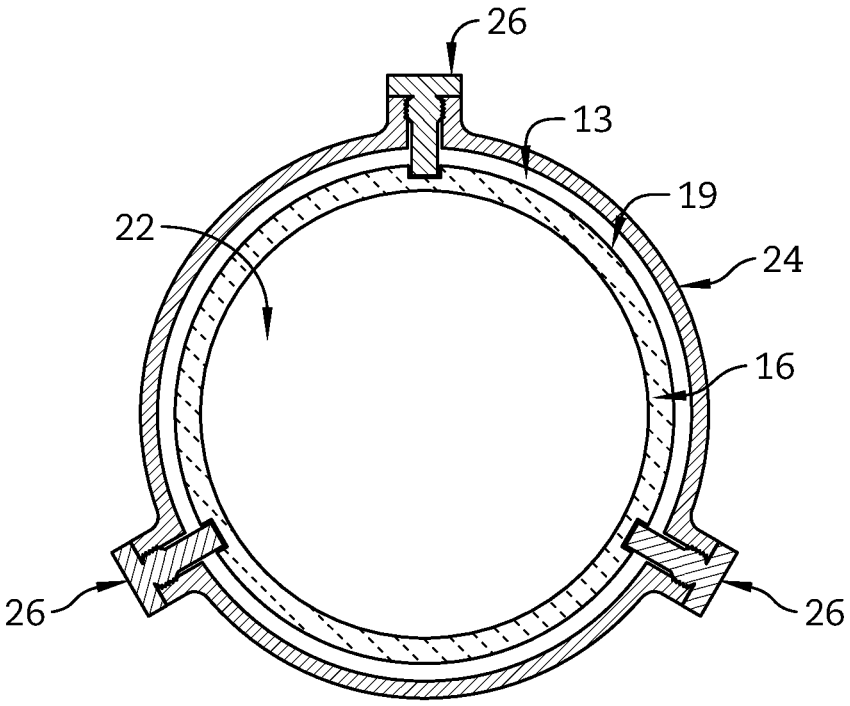
FIG. 4 is a cross-sectional view of the can-type combustor of FIG. 2 along the line 4-4.

As can be seen in FIG. 3, the pins 28 are sized to locate the hoop 16 radially inward and equidistant from a corresponding case can 24. Cross key connections 26 are equally spaced about the circumference of the can 24 to locate the hoop 16. Although three cross key connections 26 are illustrated in the embodiment, any number of cross key connections 26 that achieve the constant and equal spacing locating the hoop 16 inside the can 24 can be implemented.

Figure 5:
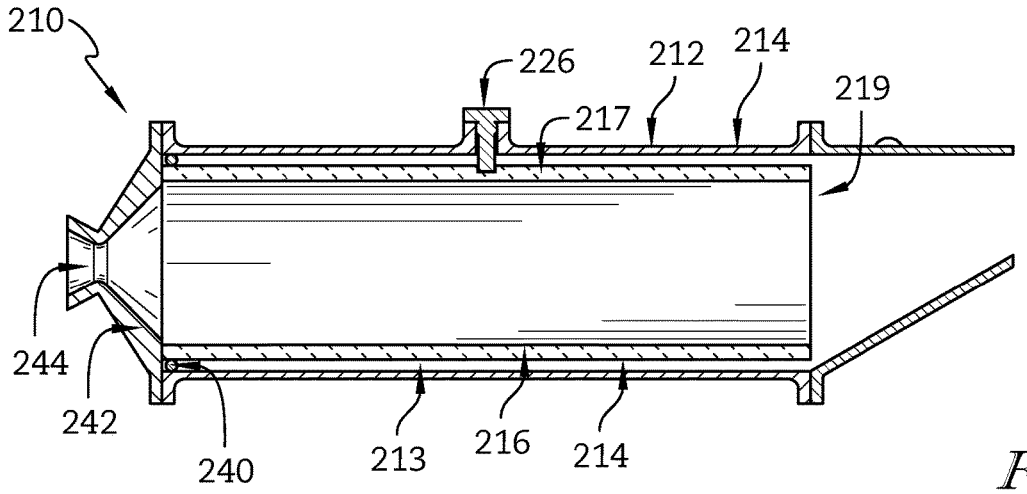
FIG. 5 is a sectional view of a portion of a second can-type combustor adapted for use in the turbine engine of FIG. 1 showing the combustor includes a ceramic liner, a metallic case, and a ceramic piston therebetween.

Another illustrative combustor 210 adapted for use in the gas turbine engine 110 is show in FIG. 5. The combustor 210 is substantially similar to the combustor 10 show in FIGS. 1-4 described herein. Accordingly, similar reference numbers in the 200 series not specifically discussed herein indicate features that are common between combustor 10 and combustor 210. The description of the combustor 10 is hereby incorporated by reference to apply to the combustor 210 except in instances where it conflicts with the specific description and drawings of combustor 210.

Unlike combustor 10, the combustor 210 includes case cans 224 that have an endcap 242 at a proximal end of the can 224 and the can liners 217 do not have a dome at a proximal end as shown in FIG. 5. Rather the combustor 210 is configured to connect to fuel nozzles 142 via openings 244 in endcaps 242 of the case cans 224. Endcaps 242 are formed of the same metallic material as the case cans 224. Additionally, combustor 210 includes seal ring 240 fitted between the hoop 216 and the can 224. Seal ring 240 provides a seal between hoop 216, and can 224 and prevents heat from entering cooling channel 213. In some embodiments the seal ring 240 may be implemented by a ceramic piston seal.

Figure 6:
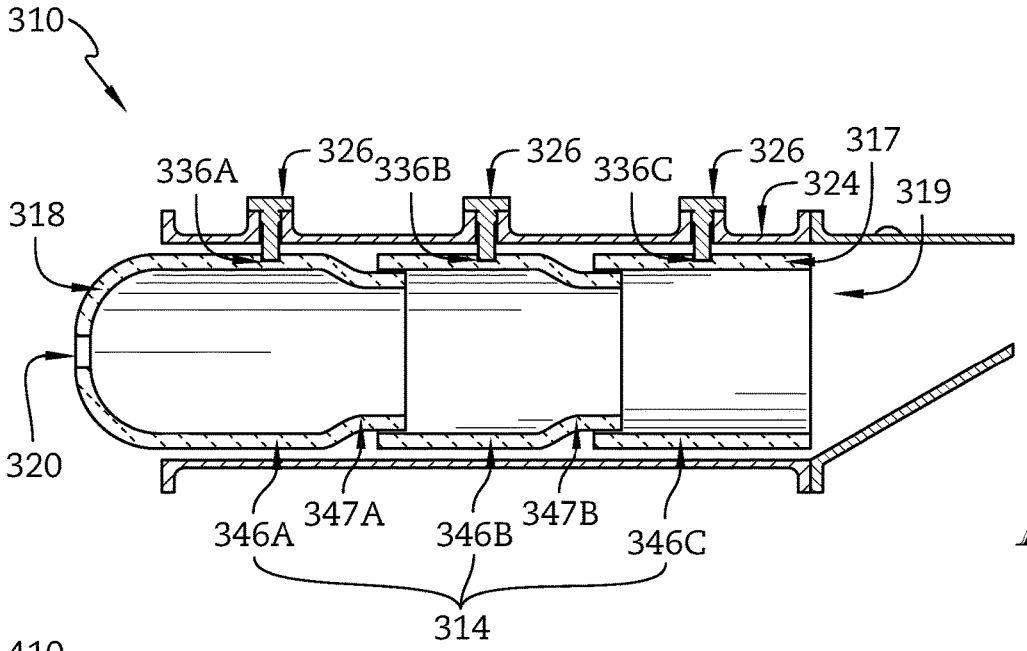
FIG. 6 is a sectional view of a portion of a third can-type combustor adapted for use in the turbine engine of FIG. 1 showing the combustor includes a plurality of partially overlapping ceramic hoops, one hoop having a domed end, and a metallic case.

Another illustrative combustor 310 adapted for use in the gas turbine engine 110 is show in FIG. 6. The combustor 310 is substantially similar to the combustor 10 show in FIGS. 1-4 described herein. Accordingly, similar reference numbers in the 300 series not specifically discussed herein indicate features that are common between combustor 10 and combustor 310. The description of the combustor 10 is hereby incorporated by reference to apply to the combustor 310 except in instances where it conflicts with the specific description and drawings of combustor 310.

Unlike combustor 10, the combustor 310 includes a plurality of full hoops 346A, 346B, 346C included in each can liner 317. The first hoop 326A at a forward end of a can liner 317 is integrally formed with a dome-shaped proximal end 318 of the can liner 317. An opening 320 is formed in the domed-shaped proximal end 818 to accommodate a fuel nozzle 142. Hoops 346A 346B have sloped distal ends 347A-347B so that the distal end of each hoop nests in an adjacent hoop. The sloped distal end of each hoop may be spaced radially from each adjacent hoop by a predetermined distance so that cooling film may be pushed in through the space and distally along each adjacent hoop. Hoops 346A, 346B, 346C, all are formed to have the same circumference at the cross key connection points where blind holes 336A-336C are formed to locate each hoop the same distance radially inward from the can 324. Case cans 324 have threaded bosses 338, spaced not only circumferentially, as shown in FIG. 3, but also longitudinally along the case cans 324 to secure each hoop 346A, 346B, 346C inside the annular opening 315. Although illustratively depicted as three hoops, more or fewer hoops may be implemented.

Figure 7:
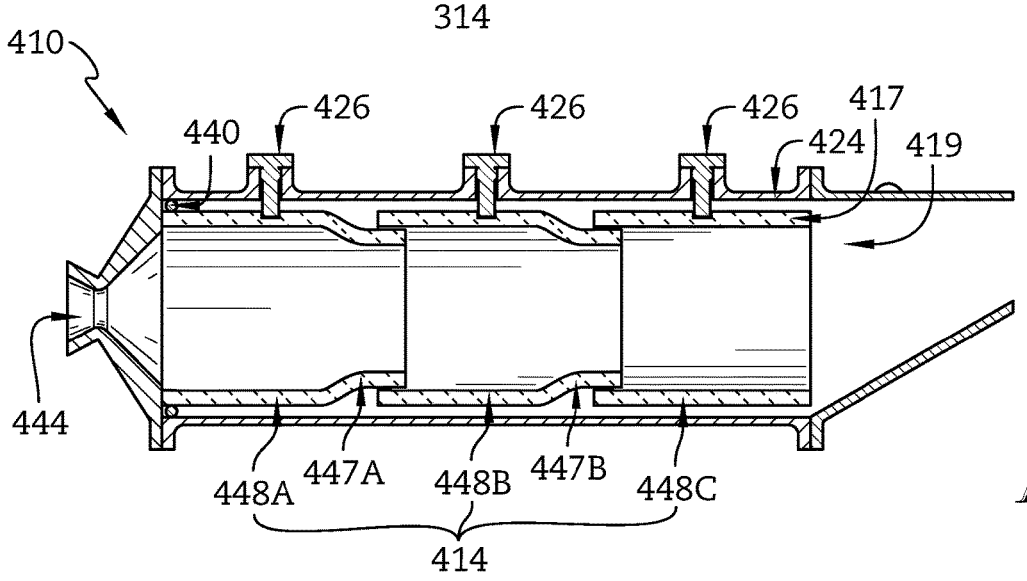
FIG. 7 is a sectional view of a portion of a fourth can-type combustor adapted for use in the turbine engine of FIG. 1 showing the combustor includes a plurality of partially overlapping ceramic hoops and a metallic case.

Another illustrative combustor 410 adapted for use in the gas turbine engine 110 is show in FIG. 7. The combustor 410 is substantially similar to the combustor 10 show in FIGS. 1 and 5 described herein. Accordingly, similar reference numbers in the 300 series not discussed herein indicate features that are common between combustor 10 and combustor 410. The description of the combustor 10 is hereby incorporated by reference to apply to the combustor 410 except in instances where it conflicts with the specific description and drawings of combustor 410.

Combustor 410 differs from combustor 10 in that it has a plurality of full hoops 448A, 448B, 448C included in each can liner 417. Combustor 410 is configured to connect to fuel nozzle 142 via opening 444 in an endcap 442 included in each case can 424. Endcaps 442 are formed of the same metallic material as the case cans 424. Additionally, combustor 410 includes seal ring 440 fitted between the hoop 448A and the case can 424. Seal ring 440 prevents heat from entering channel 413 at the proximal end. Hoops 448A 448B have sloped distal ends 447A-447B so that the distal end of each hoop nests in an adjacent hoop. Hoops 448A, 448B, 448C, all are formed to have the same circumference at the cross key connection points where the blind holes are formed to locate each hoop the same distance radially inward from the can 424.

Figure 8:
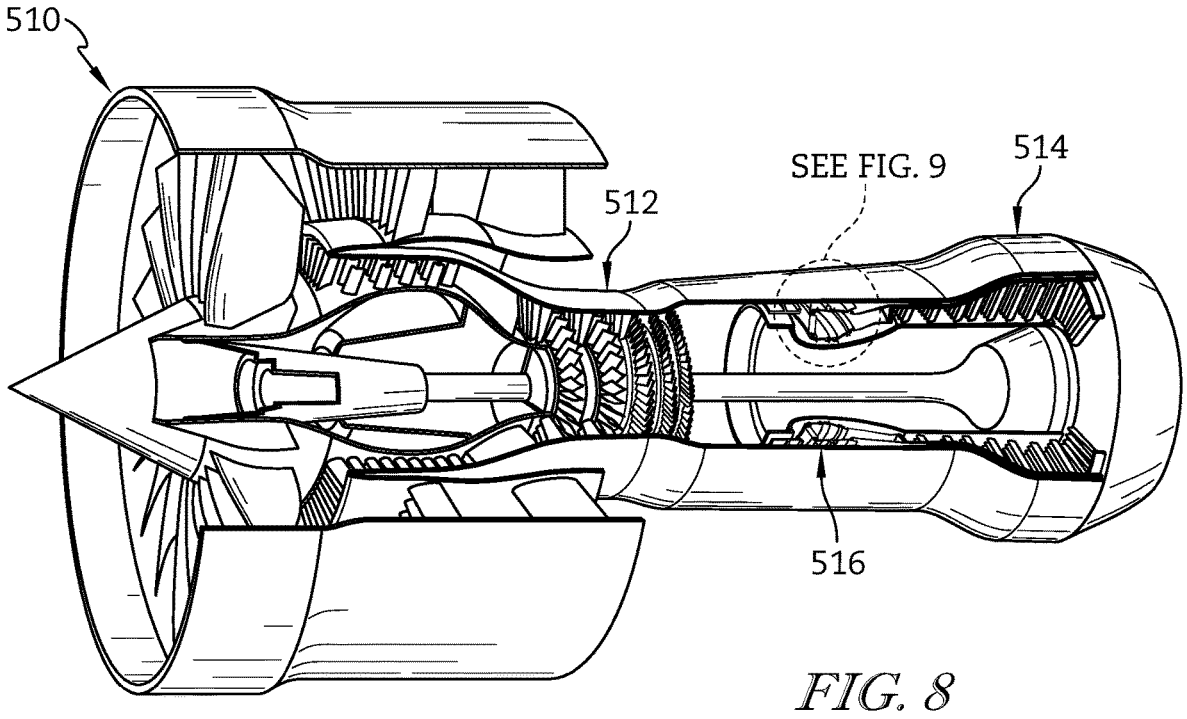
FIG. 8 is a perspective cut-away view of a turbine engine showing that the engine includes a full-annular-type combustor.

An arrangement of another illustrative combustor 516 in a gas turbine engine 510 is shown in FIG. 8. The combustor 516 is illustratively of the full-annular-type and includes a case 518, a liner 526, and a cross key connection 538. The liner 526 protects the metallic case 518 from heat generated by the combustion reaction contained therein. The cross key connection 538 locates the liner 526 in a radially interior space relative the case 518 without requiring fasteners that extend through parts of the liner into an internal combustion cavity of the liner 526.

Figure 9:
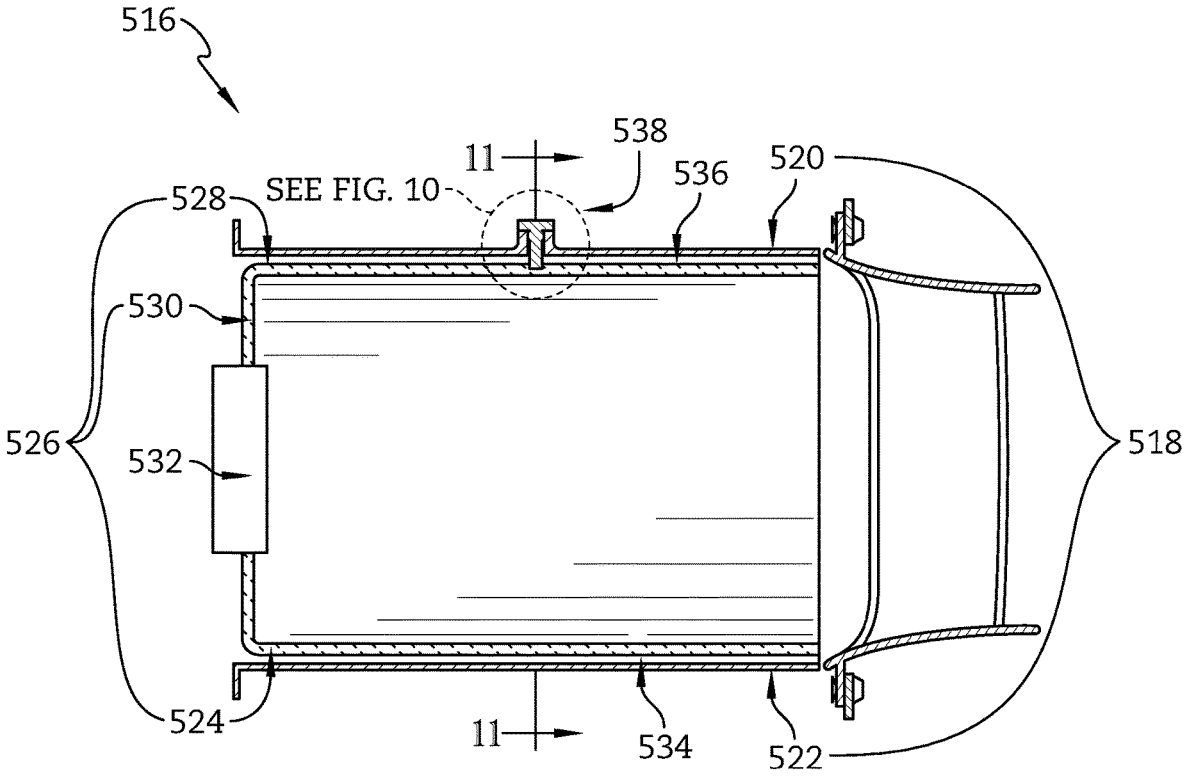
FIG. 9 is a sectional view of the combustor of FIG. 8, showing that the combustor includes a domed ceramic liner mounted to a metallic case by cross key connectors.

The case 518 illustratively comprises metallic materials and includes an outer annular wall 520 and an inner annular wall 522 that is generally concentric with and inside the outer annular wall 520 as shown in FIG. 9. The outer annular wall 520 is coupled by a cross key connection 538 with the liner 526 as seen in FIG. 9.

The liner 526 comprises a ceramic matrix composite material and includes a radially inner annular wall 524 and an outer annular wall 528 defining an internal combustion cavity 533 therebetween. The inner and outer annular walls 524, 528 are connected at a proximal end via a domed ceramic surface 530. The liner 526 is sized to fit radially inside the opening formed between the inner and outer annular walls 520 522 of the case 518 so that inner radial channel 534 and outer radial channel 536 exist between the liner 526 and the case 518. An opening 532 is formed in the domed-shaped proximal end 18 to accommodate a fuel nozzle. In some embodiments, cooling holes (not shown) may be machined or otherwise formed in the liner 526 to force pressurized cooling air to enter the combustion cavity.

Cross key connection 538 includes three or more pins 540 having a head 542 and a shank 546. Adjacent the head 542, a plurality of threads 544 are formed on a proximal end of the shank 546. Pins 540 are formed to extend through and threadingly engage a threaded boss 550 via the threads 544 on a pin 540. The distal end of the shank 546 of the pin 540, opposite the threads 544, is sized to fit into blind hole 548 of outer annular wall 528 of liner 526.

Figure 11:
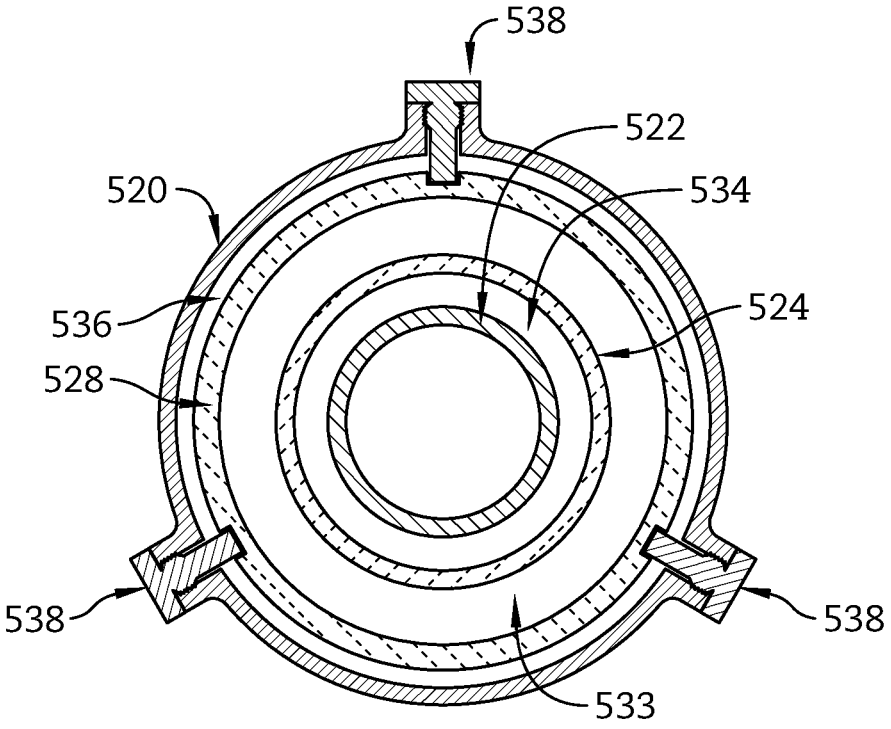
FIG. 11 is a cross-sectional view of the combustor of FIG. 9 along the line 11-11.

As can be seen in FIG. 11, the pins 540 are sized to locate the inner and outer annular liner walls 524, 528 radially inward the annular outer wall 520 of case 518 and radially outside the inner annular wall 522 of the case 518. Cross key connections 538 are equally spaced about the circumference of the outer annular wall 520 to locate the liner 514 Although three cross key connections 538 are illustrated in the embodiment, any number of cross key connections 538 that achieve the constant and equal spacing locating the liner 518 inside the outer annular wall 520 can be implemented. In this particular embodiment, no cross key connects are required to connect inner annular wall 522 of case and inner annular wall 524 of liner. This is due to the domed front end 530 of liner connecting the inner and outer annular walls 524, 528 of the liner 526. Because of the domed front end 530, the locating done by the cross key connections 538 between outer annular wall 520 of case 518 and outer annular wall 528 of liner 526 will provide corresponding locating between inner annular wall 522 of case 578 and inner annular wall of liner 524.

Figure 12:
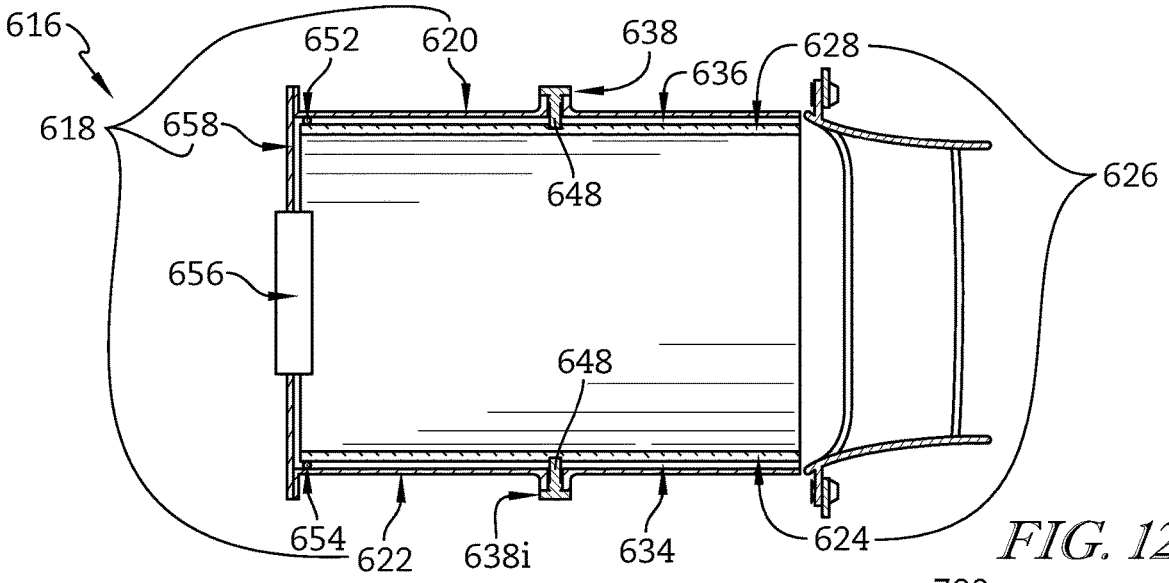
FIG. 12 is a sectional view of a second full-annular-type combustor adapted for use in the turbine engine of FIG. 8 showing a ceramic liner, a metallic case, and a ceramic ring seal therebetween.

Another illustrative combustor 616 adapted for use in the gas turbine engine 510 is show in FIG. 12. The combustor 616 is substantially similar to the combustor 516 show in FIGS. 8-9 described herein. Accordingly, similar reference numbers in the 600 series not discussed herein indicate features that are common between combustor 516 and combustor 616. The description of the combustor 516 is hereby incorporated by reference to apply to the combustor 516 except in instances where it conflicts with the specific description and drawings of combustor 616.

Unlike combustor 516, the combustor 616 includes a monolithic full annular inner hoop 624 and monolithic full annular outer hoop 628 that are not connected via domed ceramic surface at a proximal end forming the liner 526. Rather the combustor 616 is configured to connect to fuel nozzles via openings 656 in an endcap 658 of the case 518. Endcap 658 is formed of the same metallic material as the case 618. Additionally, combustor includes an inner seal ring 654 fitted between the inner annular liner hoop 624 and inner case wall 622, and an outer seal ring 652 fitted between the outer annular liner hoop 628 and outer annular case wall 620. Seal rings 654, 652 provide a seal between liner 626 and the case 618 and prevent heat from entering inner annular channel 634 and outer annular channel 636.

Figure 10:
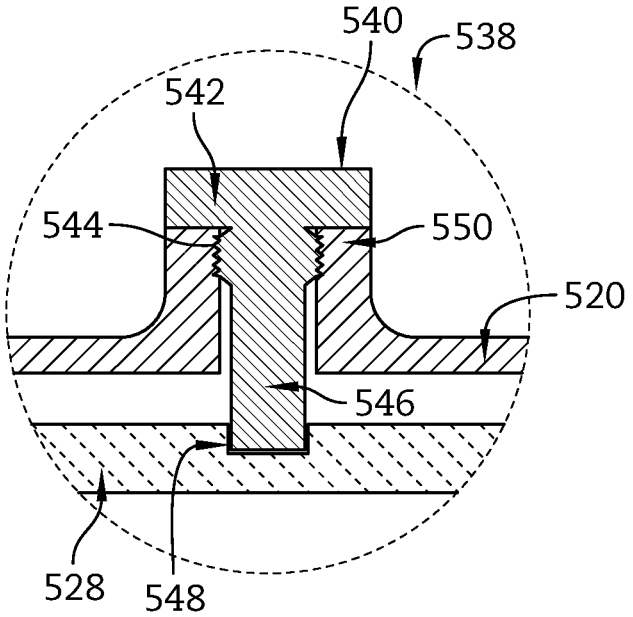
FIG. 10 is a zoomed in view of the connector of FIG. 9 that connects the ceramic liner to the metallic case.

Additionally in this embodiment, both inner and outer case walls 620, 622, form cross key connections with the liner 526 since the inner and outer liner hoops 624, 628 are not connected. Similar to the outer cross key connectors of FIG. 10, inner cross key connectors 638*i* will include threaded bosses 650*i* circumferentially spaced about the inner annular case wall 624 and inner blind holes 648*i* with threaded pins 640*i* extending through and threadingly engaging threaded bosses 650*i* and shanks extending into blind holes 648*i* of the inner annular hoop 624 to locate the inner annular hoop 624 radially outward relative to the inner annular case 622.

Figure 13:
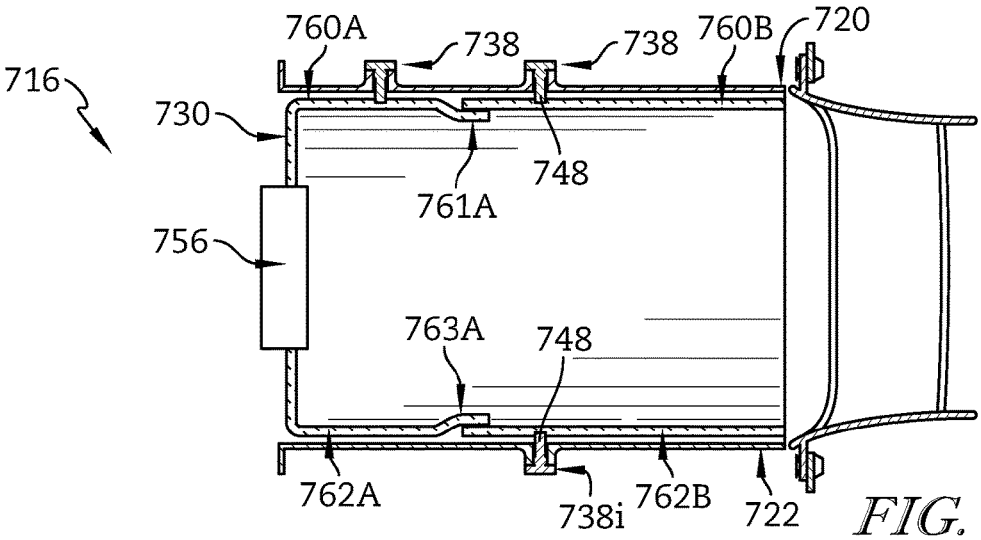
FIG. 13 is a sectional view of a third full-annular-type combustor adapted for use in the turbine engine of FIG. 8 showing the combustor includes a plurality of partially overlapping ceramic hoops, one hoop having a domed end, and a metallic case.

Another illustrative combustor 816 adapted for use in the gas turbine engine 510 is show in FIG. 13. The combustor 816 is substantially similar to the combustor 516 show in FIGS. 8-9 described herein. Accordingly, similar reference numbers in the 800 series not discussed below indicate features that are common between combustor 516 and combustor 816. The description of the combustor 516 is hereby incorporated by reference to apply to the combustor 816 except in instances where it conflicts with the specific description and drawings of combustor 816.

Unlike combustor 516, the combustor 816 includes a plurality of outer full hoops 760A, 760B and a plurality of inner full hoops 762A 762B form the liner 626. The first outer and inner hoops 760A, 762A are joined at a forward end by a dome-shaped proximal end 730. Openings 756 are formed in the domed-shaped proximal end 730 to accommodate fuel nozzles. Inner and outer hoops 760A, 762A have sloped distal ends 761A, 763A so that the distal end of each hoop nests in an adjacent hoop. The sloped distal end of each hoop may be spaced radially from each adjacent hoop by a predetermined distance so that cooling film may be pushed in and distally along each adjacent hoop.

Hoops 760A, 760B are formed to have the same circumference at the cross key connection points 738 where the blind holes 748 are formed to locate each hoop the same distance radially inward from the outer annular case wall 720. Inner hoop 762B is formed to have the same circumference at the cross key connection point 738*i* where the blind holes are formed to locate inner hoop 762B a distance radially outward from the inner annular case wall 722. Inner hoop 762A does not require a cross key connection with inner annular wall 722 as it is connected via the domed end 730 and therefore located via the cross key connection 738 at outer hoop 760A. Although illustratively depicted as two hoops, more or fewer hoops may be implemented.

Figure 14:
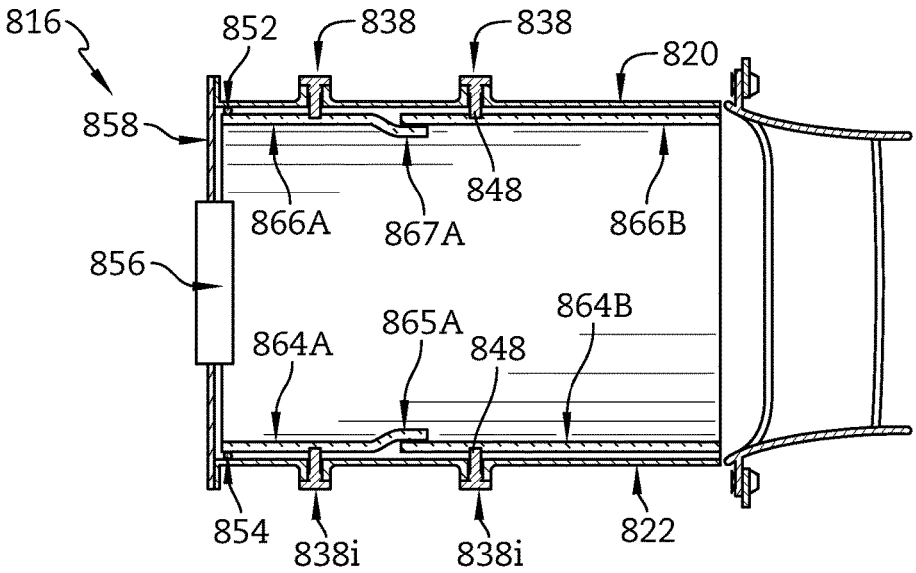
FIG. 14 is a sectional view of a fourth full-annular-type combustor adapted for use in the turbine engine of FIG. 8 showing the combustor includes a plurality of partially overlapping ceramic hoops and a metallic case.

Another illustrative combustor 816 adapted for use in the gas turbine engine 510 is shown in FIG. 14. The combustor 816 is substantially similar to the combustor 516 shown in FIGS. 8 and 9 described herein. Accordingly, similar reference numbers in the 800 series not further discussed herein indicate features that are common between combustor 516 and combustor 816. The description of the 516 combustor is hereby incorporated by reference to apply to the combustor 816 except in instances where it conflicts with the specific description and drawings of combustor 816.

Combustor 816 differs from combustor 516 in that it has a plurality of full outer hoops 866A, 866B and full inner hoops 864A, 864B forming the liner 814. Combustor 816 is configured to connect to fuel nozzles via openings 856 in an endcap 858 included in the case 818. Endcap 858 is formed of the same metallic material as the case 818. Inner and outer seal rings 854, 852 form a seal between outer annular case wall 820 and outer annular hoop 866A, and a seal between inner annular hoop 864A and inner annular case wall 822. Inner seal ring 854 and outer seal ring 852 provide a seal between liner 826 and the case 818 and prevent heat from entering inner annular channel 834 and outer annular channel 836. Inner and outer hoops 866A, 864A have sloped distal ends 865A, 867A so that the distal end of each hoop nests in an adjacent hoop.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising a case comprising metallic materials adapted to be mounted in a gas turbine engine and formed to define an interior space, a combustion liner comprising ceramic matrix composite materials arranged in the interior space of the case, the combustion liner shaped to define a combustion chamber within the case and shield at least a portion of the case from the combustion chamber, a plurality of pins that extend through the case and into blind holes formed in the combustion liner to provide cross key connections between the case and the combustion liner locating the combustion liner relative to the case, wherein the combustion liner is formed to comprise at least one full monolithic ceramic hoop including a plurality of the blind holes circumferentially spaced around the at least one full monolithic ceramic hoop for centrally locating the at least one full monolithic ceramic hoop within the case with the plurality of pins, wherein the plurality of pins are unrestricted within the blind holes so as to allow for radial inward and outward movement relative to the combustion liner, wherein each of the plurality of pins includes a head that couples with the case and a cylindrical shank that extends into each of the plurality of the blind holes formed in the combustion liner, and wherein the head of each of the plurality of pins includes threads that couple the plurality of pins to the case, and wherein in operation the plurality of pins are configured to achieve constant and equal spacing in locating the combustion liner inside the case.

2. The combustor of claim 1, wherein the case comprises a plurality of cans and the combustion liner includes a plurality of can liners.

3. The combustor of claim 2, wherein each can liner of the plurality of can liners includes a cylindrical body, a domed front end, and a fuel entry aperture formed through the domed front end.

4. The combustor of claim 3, wherein the at least one full monolithic ceramic hoop comprises a plurality of hoops, each of the plurality of can liners comprises the plurality of hoops that nest with each other such that a trailing edge of a first hoop overlaps a leading edge of an adjacent second hoop.

5. The combustor of claim 2, wherein a ceramic ring forms a seal at a front end between each of the plurality of cans and a respective each of the plurality of can liners preventing heat from entering a cylindrical interior space between each of the plurality of cans and respective each of the plurality of can liners.

6. The combustor of claim 5, wherein the at least one full monolithic ceramic hoop comprises a plurality of hoops, the respective each of the plurality of can liners comprises the plurality of hoops that nest with each other such that a trailing edge of a first hoop overlaps a leading edge of an adjacent second hoop.

7. The combustor of claim 1, wherein the case comprises a radially outer annular wall and a radially inner annular wall and the combustion liner comprises a radially inner full monolithic ceramic hoop and a radially outer full monolithic ceramic hoop located in between the radially outer annular wall and the radially inner annular wall.

8. The combustor of claim 7, wherein the combustion liner further comprises a domed front end connecting the radially inner full monolithic ceramic hoop and the radially outer full monolithic ceramic hoop and a plurality of fuel entry apertures formed in the domed front end, wherein the combustion liner and the radially inner annular wall and the radially outer annular wall define a radially inner space and a radially outer space therebetween.

9. The combustor of claim 8, wherein the radially inner full monolithic ceramic hoop further comprises a plurality of radially inner hoops that nest with each other such that a trailing edge of a first radially inner hoop overlaps a leading edge of an adjacent second radially inner hoop, and the radially outer full monolithic ceramic hoop comprises a plurality of radially outer hoops that nest with each other such that a trailing edge of a first radially outer hoop overlaps a leading edge of an adjacent second radially outer hoop.

10. The combustor of claim 7, wherein the radially inner full monolithic ceramic hoop further comprises a plurality of radially inner hoops that nest with each other such that a trailing edge of a first radially inner hoop overlaps a leading edge of an adjacent second radially inner hoop, and the radially outer full monolithic ceramic hoop comprises a plurality of radially outer hoops that nest with each other such that a trailing edge of a first radially outer hoop overlaps a leading edge of an adjacent second radially outer hoop.

11. The combustor of claim 10, wherein a domed front end formed to include a plurality of fuel entry apertures connects the first radially inner hoop and the first radially outer hoop.

12. The combustor of claim 7, wherein cross key connections are established between the radially outer annular wall of the case and the radially outer full monolithic ceramic hoop of the combustion liner; and cross key connections are established between the radially inner annular wall of the case and the radially inner full monolithic ceramic hoop of the combustion liner.

13. The combustor of claim 12, wherein the radially inner full monolithic ceramic hoop further comprises a plurality of radially inner hoops that nest with each other such that a trailing edge of a first radially inner hoop overlaps a leading edge of an adjacent second radially inner hoop, the radially outer full monolithic ceramic hoop comprises a plurality of radially outer hoops that nest with each other such that a trailing edge of a first radially outer hoop overlaps a leading edge of an adjacent second radially outer hoop; and wherein cross key connections are established between each of the plurality of radially outer hoops and the radially outer annular wall and between each of the plurality of radially inner hoops and the radially inner annular wall.

14. The combustor of claim 13, wherein a domed front end with a fuel entry aperture connects the first radially inner hoop and the first radially outer hoop, and the connected first radially inner hoop and first radially outer hoop are located in the case via a cross key connection through the radially outer annular wall.

15. A method of assembling a combustor, the method comprising positioning a combustion liner comprising ceramic matrix composite materials in an interior space formed by a case comprising metallic materials, the combustion liner shaped to define a combustion chamber within the interior space and to shield at least a portion of the case from the combustion chamber, and establishing cross key connections between the combustion liner and the case by inserting a plurality of pins through the case and into the combustion liner, wherein the combustion liner is formed to comprise at least one full monolithic ceramic hoop including a plurality of blind holes circumferentially spaced around the hoop for centrally locating the hoop within the case with the plurality of pins, and wherein the plurality of pins includes at least three pins equally spaced circumferentially around the hoop, wherein the plurality of pins are unrestricted within the blind holes so as to allow for radial inward and outward movement relative to the combustion liner, wherein each of the plurality of pins includes a head that couples with the case and a cylindrical shank that extends into each of the plurality of the blind holes formed in the combustion liner, and wherein the head of each of the plurality of pins includes includes threads that couples the plurality of pins to the case, and wherein in operation the plurality of pins are configured to achieve constant and equal spacing in locating the combustion liner inside the case.

16. The method of claim 15, wherein the combustion liner comprises a smooth surfaced radially inner ceramic hoop and a radially outer ceramic hoop including circumferentially spaced apart blind holes, the inner and outer ceramic hoops connected at an axially forward end via a domed front end; wherein the cross-key connections are established by inserting the plurality of pins into the blind holes on the outer ceramic hoop to locate the combustion liner in the case.

17. A combustor for use in a gas turbine engine, the combustor comprising a case comprising metallic materials adapted to be mounted in a gas turbine engine and formed to define an interior space, a combustion liner comprising ceramic matrix composite materials arranged in the interior space of the case, the combustion liner shaped to define a combustion chamber within the case and shield at least a portion of the case from the combustion chamber and include a plurality of can liners having a cylindrical body, and a plurality of pins that extend through the case and into blind holes formed in the combustion liner to provide cross key connections between the case and the combustion liner locating the combustion liner relative to the case, wherein the combustion liner comprises a plurality of hoops that are each formed to include a sloped end at a trailing edge of the hoop such that the trailing edge of a first hoop nests radially within a leading edge of an adjacent second hoop, wherein each pin of the plurality of pins includes a cylindrical distal end located in a respective one of the blind holes and all portions of each pin of the plurality of pins in the respective blind hole is arranged in direct confronting relation with a side surface of the respective blind hole, wherein the plurality of pins are unrestricted within the blind holes so as to allow for radial inward and outward movement relative to the combustion liner, wherein each of the plurality of pins includes a head with threads that couples the plurality of pins to the case, wherein in operation the plurality of pins are configured to achieve constant and equal spacing in locating the combustion liner inside the case, and wherein the plurality of hoops have the same circumference at the cross key connections.

* * * * *